US010347191B2

(12) United States Patent
Park et al.

(10) Patent No.: US 10,347,191 B2
(45) Date of Patent: Jul. 9, 2019

(54) METHOD OF DRIVING DISPLAY PANEL USING A PLURALITY OF CLOCK SIGNALS AND DISPLAY APPARATUS FOR PERFORMING THE SAME

(75) Inventors: Dong-Won Park, Hwaseong-si (KR); Bong-Hyun You, Yongin-si (KR); Jae-Sung Bae, Suwon-si (KR); Jai-Hyun Koh, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 233 days.

(21) Appl. No.: 13/241,419

(22) Filed: Sep. 23, 2011

(65) Prior Publication Data

US 2012/0194488 A1 Aug. 2, 2012

(30) Foreign Application Priority Data

Feb. 1, 2011 (KR) ..... 10-2011-0009914

(51) Int. Cl.
*G09G 3/34* (2006.01)
*G09G 3/20* (2006.01)

(52) U.S. Cl.
CPC ..... *G09G 3/3406* (2013.01); *G09G 3/2096* (2013.01); *G09G 2320/0209* (2013.01); *G09G 2320/064* (2013.01)

(58) Field of Classification Search
CPC ..... G09G 3/2096; G09G 3/3406
USPC ..... 345/419
See application file for complete search history.

(56) References Cited

U.S. PATENT DOCUMENTS

| | | | | |
|---|---|---|---|---|
| 6,184,905 | B1 * | 2/2001 | Hartog | 345/534 |
| 2005/0127947 | A1 * | 6/2005 | Arnold | H03K 19/00384 326/93 |
| 2005/0219187 | A1 * | 10/2005 | Shih | G09G 3/3659 345/94 |
| 2007/0279359 | A1 * | 12/2007 | Yoshida et al. | 345/89 |
| 2008/0079686 | A1 | 4/2008 | Cernasov | |
| 2010/0134393 | A1 | 6/2010 | Chen et al. | |
| 2011/0234287 | A1 * | 9/2011 | Murray | 327/299 |
| 2012/0019514 | A1 * | 1/2012 | Chao et al. | 345/419 |

FOREIGN PATENT DOCUMENTS

| | | |
|---|---|---|
| JP | 2009-025436 | 2/2009 |
| KR | 10-2007-0115524 | 6/2007 |
| KR | 10-2009-0088775 | 8/2009 |
| KR | 10-2010-0068730 | 6/2010 |

* cited by examiner

*Primary Examiner* — Hang Lin
(74) *Attorney, Agent, or Firm* — H.C. Park & Associates, PLC

(57) ABSTRACT

A method of driving a display panel includes providing a first clock signal having a first frequency and a second clock signal having a second frequency different from the first frequency. The method also includes providing a data signal of an N-th frame image to the display panel using the first clock signal, and providing a data signal of an (N+1)-th frame image to the display panel using the second clock signal. N is a natural number.

17 Claims, 4 Drawing Sheets

METHOD OF DRIVING DISPLAY PANEL USING A PLURALITY OF CLOCK SIGNALS AND DISPLAY APPARATUS FOR PERFORMING THE SAME

CROSS REFERENCE TO RELATED APPLICATION

This application claims priority from and the benefit of Korean Patent Application No. 2011-0009914, filed on Feb. 1, 2011, which is hereby incorporated by reference for all purposes as if fully set forth herein.

BACKGROUND OF THE INVENTION

Field of the Invention

Exemplary embodiments of the present invention relate to a method of driving a display panel and a display apparatus for performing the method. Exemplary embodiments of the present invention also relate to a method of driving a display panel to improve a display quality and a display apparatus for performing the method.

Description of the Background

Generally, a liquid crystal display apparatus displays a two-dimensional ("2D") image. Recently, due to an increase in demand of three-dimensional ("3D") image display in video games and movies, a liquid crystal display apparatus has been developed to display a 3D image.

In general, a stereoscopic image display apparatus may display a 3D image by using a binocular parallax between the two eyes of a human. For example, since the two eyes of a person are spaced apart, images viewed by the two eyes at different angles are received by a human brain. Thus, a viewer may recognize a stereoscopic image through the stereoscopic image display apparatus.

The stereoscopic image display device may include a stereoscopic type and an auto-stereoscopic type depending on whether a viewer is wearing an extra spectacle. For example, the stereoscopic type may include an anaglyph type or a shutter glass type. In the anaglyph type, a viewer may wear blue and red colored glasses to view a 3D image. In the shutter glass type, a left eye image and a right eye image may be temporally divided to be periodically displayed. The viewer may wear glasses which open and close the left and right eye shutter in synchronization with the period of the left and right images, respectively.

In the shutter glass type, a crosstalk, which occurs when a left eye image is viewed by the right eye of the viewer and a right eye image is viewed in the left eye of the viewer, may be caused due to a response delay of a liquid crystal.

In order to prevent crosstalk, a light source part may be turned off during an N-th frame, but the light source part may be turned on during an (N+1)-th frame. N may be a natural number. In addition, the light source part may be turned off during half of the entire display time so that luminance of the display apparatus may be decreased.

As explained above, the display quality of the display apparatus may be deteriorated due to the crosstalk or a decrease of the luminance of the display apparatus.

SUMMARY OF THE INVENTION

Exemplary embodiments of the present invention provide a method of driving a display panel that controls a duration of a frame period to improve a display quality.

Additional features of the invention will be set forth in the description which follows, and in part will be apparent from the description, or may be learned by practice of the invention.

Exemplary embodiments of the present invention provide a method of driving a display panel. The method includes providing a first clock signal having a first frequency, and providing a data signal of an N-th frame image to the display panel using the first clock signal. N is a natural number. The method further includes providing a second clock signal having a second frequency. The second frequency is different from the first frequency. The method further includes producing a data signal of an (N+1)-th frame image to the display panel using the second clock signal.

Exemplary embodiments of the present invention also provide a display apparatus including a display panel and a timing controller. The display panel displays an image. The timing controller provides a first clock signal having a first frequency and a second clock signal having a second frequency different from the first frequency. The timing controller provides a data signal of an N-th frame image to the display panel using the first clock signal and a data signal of an (N+1)-th frame image to the display panel using the second clock signal. N is a natural number.

Additional features of the invention will be set forth in the description which follows, and in part will be apparent from the description, or may be learned by practice of the invention.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
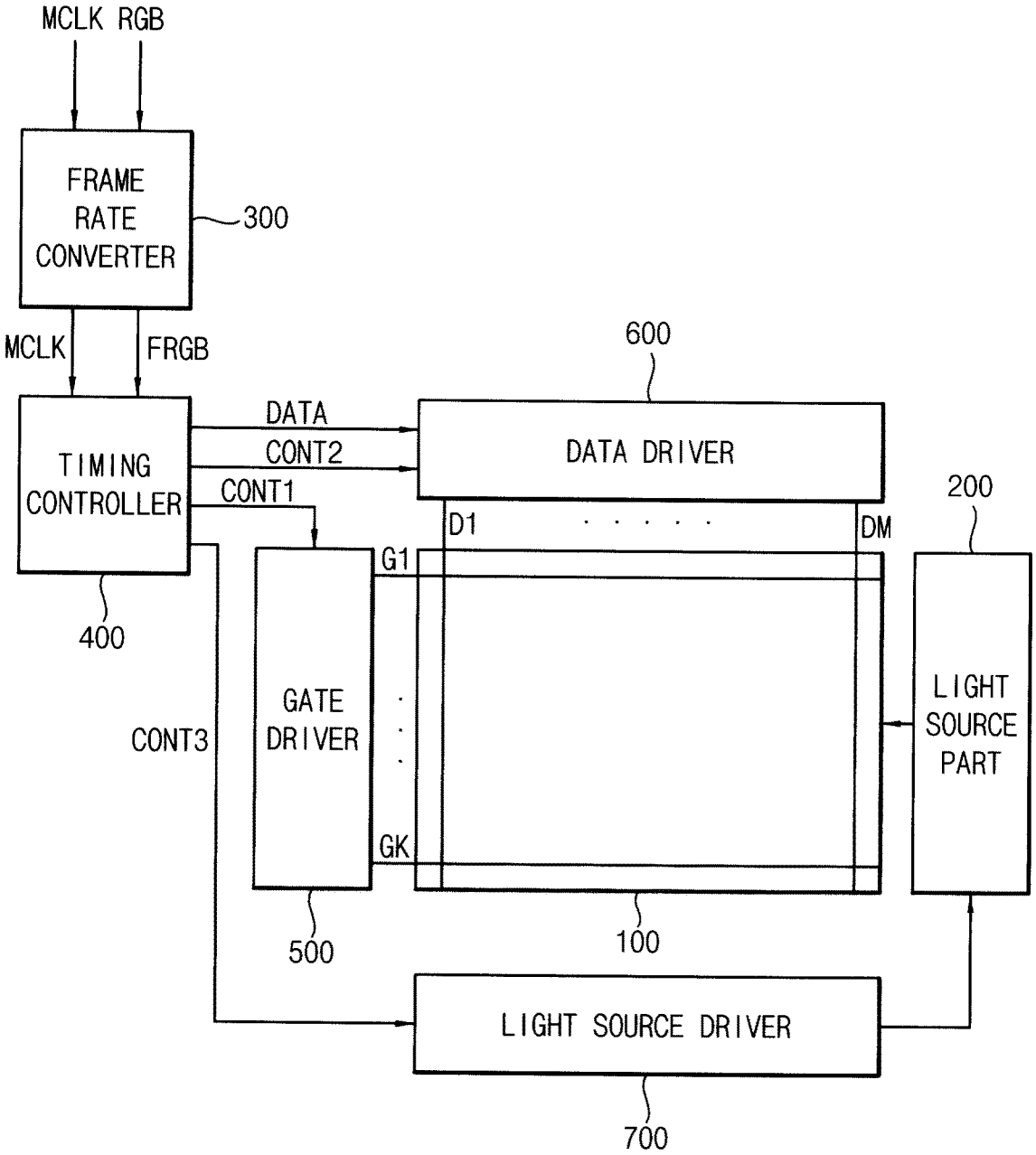
FIG. 1 is a block diagram illustrating a display apparatus according to exemplary embodiments of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing exemplary embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Hereinafter, exemplary embodiments of the present invention will be described in further detail with reference to the accompanying drawings.

FIG. 1 is a block diagram illustrating a display apparatus according to exemplary embodiments of the present invention.

Referring to FIG. 1, the display apparatus may include a display panel 100, a light source part 200, a frame rate converter ("FRC") 300, a timing controller 400, a gate driver 500, a data driver 600, and a light source driver 700.

The display panel 100 may include a plurality of gate lines G1 to GK, a plurality of data lines D1 to DM, and a plurality of pixels connected to the gate lines G1 to GK and the data lines D1 to DM. K and M are natural numbers.

The gate lines G1 to GK may extend in a first direction, and the data lines D1 to DM extend in a second direction crossing the first direction. The second direction may be substantially perpendicular to the first direction. The second direction may be substantially perpendicular to the first direction. For example, the gate lines G1 to GK may extend in a direction corresponding to a row of pixels in the display panel 100, and the data lines D1 to DM may extend in a direction corresponding to a column of pixels in the display panel 100.

Each pixel may include a switching element (e.g., transistor) (not shown), a liquid crystal capacitor (not shown), and a storage capacitor (not shown). The liquid crystal capacitor and the storage capacitor may be electrically connected to the switching element.

The display panel 100 may be able to display a two-dimensional ("2D") image or a three-dimensional ("3D") image. When the display panel 100 displays a 3D image, the display panel 100 may alternately display a left eye image and a right eye image. The display panel 100 may selectively display the 2D image and the 3D image.

The light source part 200 may provide a light (e.g., radiation) to the display panel 100. For example, the light source part 200 may include a cold cathode fluorescent lamp ("CCFL"), an external electrode fluorescent lamp ("EEFL"), a flat fluorescent lamp ("FFL"), and/or a light emitting diode ("LED").

In some cases, the light source part 200 may be a direct-type light source part, which is disposed under the display panel 100, to provide a light to the display panel 100. In some cases, the light source part 200 may be an edge-type light source part, which is disposed along an edge of the display panel 100 to provide a light to the display panel 100.

The light source part 200 is explained in detail with reference to FIG. 3.

The FRC 300 may receive an input image RGB and a master clock signal MCLK. The input image RGB and the master clock signal MCLK may be received from an external component, chip, or device. The FRC 300 may convert a frame rate of the input image RGB to generate a converted image FRGB. The FRC 300 may output the converted image FRGB to the timing controller 400.

For example, the FRC 300 may receive an input image RGB having a frame rate of 60 Hertz (Hz). The FRC 300 may convert the frame rate of the input image RGB to 240 Hz so that the converted image FRGB having the frame rate of 240 Hz may be generated.

The converted image FRGB may include a left eye image and a right eye image. The converted image FRGB may include a first left eye image having a frame rate of 60 Hz, a second left eye image having a frame rate of 60 Hz, a first right eye image having a frame rate of 60 Hz and a second right eye image having a frame rate of 60 Hz. One of the first and second left eye images may be a black image. One of the first and second right eye images may be a black image.

When the display apparatus 100 displays the 2D image, the FRC 300 may be omitted.

The timing controller 400 may receive the converted image FRGB and the master clock signal MCLK from the FRC 300. In some cases, the timing controller 400 may receive the input image RGB and/or the master clock signal MCLK from an external component, chip, or device. The timing controller 400 may also receive a control signal provided from an external component, chip, or device. The control signal may include a data enable signal, a vertical synchronizing signal, and/or a horizontal synchronizing signal.

The timing controller 400 may generate a first control signal CONT1, a second control signal CONT2, a third control signal CONT3, and a data signal DATA based on the converted image FRGB, the master clock signal MCLK, and the control signal.

The timing controller 400 may generate the first control signal CONT1 for controlling a driving timing of the gate driver 500 based on the master clock signal MCLK and the control signal. The timing controller 400 may output the first control signal CONT1 to the gate driver 500.

The timing controller 400 may generate the second control signal CONT2 for controlling a driving timing of the data driver 600 based on the master clock signal MCLK and the control signal. The timing controller 400 may output the second control signal CONT2 to the data driver 600. The timing controller 400 may process the converted image FRGB to generate the data signal DATA. The timing controller 400 may output the data signal DATA to the data driver 600.

The timing controller 400 may generate the third control signal CONT3 for controlling a driving timing of the light source driver 700 based on the master clock signal MCLK and the control signal. The timing controller 400 may output the third control signal CONT3 to the light source driver 700.

The first control signal CONT1 may include a vertical start signal and a gate clock signal. The second control signal CONT2 may include a horizontal start signal and a load signal.

The timing controller 400 may include a first clock generator generating a first clock signal based on the master clock signal MCLK. The timing controller 400 may also include a second clock generator generating a second clock signal based on the master clock signal MCLK.

The timing controller 400 is explained in detail with reference to FIG. 2.

The gate driver 500 may receive the first control signal CONT1 from the timing controller 400. The gate driver 500 may generate gate signals for driving the gate lines G1 to GK of the display panel 100 in response to the first control signal CONT1. The gate driver 500 may sequentially output the gate signals to the gate lines G1 to GK.

In some cases, the gate driver 500 may be disposed, e.g., directly mounted, on the display panel 100, or may be connected to the display panel 100 in a tape carrier package ("TCP") type manner. In some cases, the gate driver 500 may be integrated on the display panel 100.

The data driver 600 may receive the data signal DATA and the second control signal CONT2 from the timing controller 400. The data driver 600 may convert the data signal DATA into an analog-type data voltage using a gamma reference voltage in response to the second control signal CONT2. The data driver 600 may output the data voltage to the data lines D1 to DM.

A gamma voltage generator (not shown) may generate the gamma reference voltage to provide the gamma reference voltage to the data driver 600. The gamma voltage generator may be disposed in the data driver 600 or in the timing controller 400.

In some cases, the data driver 600 may be disposed, e.g., directly mounted, on the display panel 100, or be connected to the display panel 100 in a TCP type manner. In some cases, the data driver 600 may be integrated on the display panel 100.

The light source driver 700 may drive the light source part 200. The light source driver 700 may receive the third control signal CONT3 from the timing controller 400. The light source driver 700 may generate a light source driving signal based on the third control signal CONT3. The light source driver 700 may output the light source driving signal to the light source part 200.

The light source driving signal may control the power of the light source part 200, and may turn the light source part 200 on or off. The light source driving signal may be a square wave. However, it should be understood that various types of waves may be used as the light source driving signal.

If the light source part 200 includes a plurality of light source blocks, the light source driver 700 may independently drive each of the light source blocks.

Figure 2:
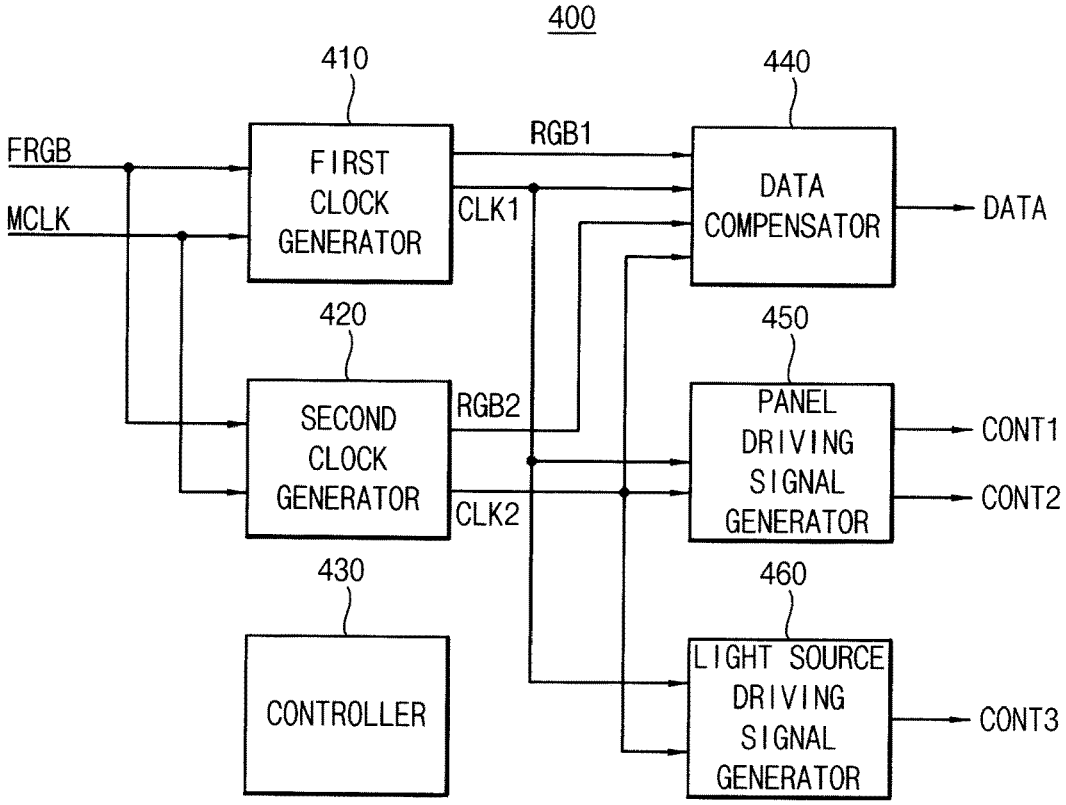
FIG. 2 is a block diagram illustrating a timing controller of FIG. 1, according to exemplary embodiments of the present invention.

FIG. 2 is a block diagram illustrating the timing controller 400 of FIG. 1, according to exemplary embodiments of the present invention.

Referring to FIG. 2, the timing controller 400 may includes first clock generator 410, a second clock generator 420, a controller 430, a data compensator 440, a panel driving signal generator 450, and a light source driving signal generator 460.

The first clock generator 410 may receive the converted image FRGB and the master clock signal MCLK from the FRC 300. The first clock generator 410 may include a first phase locked loop (PLL) (not shown) that may generate a first clock signal CLK1 based on the master clock signal MCLK. The first clock generator 410 may include a first synchronizing part (not shown) synchronizing the converted image FRGB with the first clock signal CLK1 to generate a first image RGB1.

The first clock generator 410 may output the first image RGB1 to the data compensator 440. The first clock generator 410 may output the first clock signal CLK1 to the data compensator 440, the panel driving signal generator 450, and the light source driving signal generator 460.

In some cases, the first clock generator 410 may receive the input image RGB from an external component, chip, or device. The first synchronizing part may synchronize the input image RGB with the first clock signal CLK1 to generate a first image RGB1. In some cases, the first clock generator 410 may also receive the master clock signal MCLK from an external component, chip, or device.

The second clock generator 420 may receive the converted image FRGB and the master clock signal MCLK from the FRC 300. The second clock generator 420 may include a second phase locked loop (PLL) (not shown) that may generate a second clock signal CLK2 based on the master clock signal MCLK. The second clock generator 420 may include a second synchronizing part (not shown) synchronizing the converted image FRGB with the second clock signal CLK2 to generate a second image RGB2.

The second clock generator 420 may output the second image RGB2 to the data compensator 440. The second clock generator 420 may output the second clock signal CLK2 to the data compensator 440, the panel driving signal generator 450, and the light source driving signal generator 460.

In some cases, the second clock generator 420 may receive the input image RGB from an external component, chip, or device. The second synchronizing part may synchronize the input image RGB with the second clock signal CLK2 to generate a second image RGB2.

In some cases, the second clock generator 420 may also receive the master clock signal MCLK from outside.

The first clock signal CLK1 may have a first frequency. The first frequency may be different from a frequency of the master clock signal MCLK. The second clock signal CLK2 may also have a second frequency. The second frequency may be different from the frequency of the master clock signal MCLK. For example, the frequency of the master clock signal MCLK may be one of 60 Hz, 120 Hz and 240 Hz The first frequency of the first clock signal CLK1 may be different from the second frequency of the second clock signal CLK2. For example, one of the first and second frequencies may be greater than the frequency of the master clock signal MCLK, and another may be smaller than the frequency of the master clock signal MCLK.

For example, the first frequency and the second frequency may have a predetermined ratio. The predetermined ratio may be set in the controller 430.

For example, when the frequency of the master clock signal MCLK is f0, the first frequency f1 may be f1=f0*4/3, and the second frequency f2 may be f2=f0*4/5.

For example, the frequency f0 of the master clock signal MCLK, the first frequency f1, and the second frequency f2 may satisfy following Equation 1:

$$\frac{2}{f0} = \frac{1}{f1} + \frac{1}{f2} \quad \text{[Equation 1]}$$

Since a frequency is a reciprocal of a cycle, a sum of a cycle of the first clock signal CLK1 and a cycle of the second clock signal CLK2 may be twice as great as a cycle of the master clock signal CLK.

The controller 430 may receive the ratio between the first and second frequencies of the first and second clock signals CLK1 and CLK2. The controller 430 may control operations of the first clock signal generator 410, the second clock signal generator 420, the data compensator 440, the panel driving signal generator 450, and the light source driving signal generator 460 based on the ratio between the first and second frequencies.

In some cases, the ratio between the first and second frequencies may be set by a manufacturer of the display panel 100. In some cases, the ratio between the first and second frequencies may be set by a user of the display panel 100. The ratio between the first and second frequencies may be adjusted depending on a characteristic of the display panel 100 and/or a characteristic of the input image RGB. The ratio between the first and second frequencies may also be adjusted in real time.

The data compensator 440 may receive the first and second images RGB1 and RGB2 from the first and second clock generators 410 and 420. The data compensator 440 may compensate and convert the first and second images RGB1 and RGB2 to generate the data signal DATA. The data compensator 440 may output the data signal DATA to the data driver 600.

The data compensator 440 may include an adaptive color correction part (not shown) and a dynamic capacitance compensating part (not shown).

The adaptive color correction part may receive the first and second images RGB1 and RGB2, and may perform an adaptive color correction ("ACC"). The adaptive color correction part may compensate the first and second images RGB1 and RGB2 using a gamma curve.

The dynamic capacitance compensating part may perform a dynamic capacitance compensation ("DCC") to compensate the grayscales of a present frame data using previous frame data and the present frame data.

The data compensator 440 may generate data signals of an N-th frame image based on the first clock signal CLK1. The data compensator 440 may also generate data signals of an (N+1)-th frame image based on the second clock signal CLK2. N is a natural number.

The data compensator 440 may generate data signals of an (N+2)-th frame image based on the first clock signal CLK1. The data compensator 440 may also generate data signals of an (N+3)-th frame image based on the second clock signal CLK2.

As explained above, the data compensator 440 may alternately generate the data signals of the frame images based on the first clock signal CLK1 and the data signals of the frame images based on the second clock signal CLK2.

A time period corresponding to the N-th frame image may be defined as an N-th frame period. A time period corresponding to the (N+1)-th frame image may be defined as an (N+1)-th frame period. A time period corresponding to the (N+2)-th frame image may be defined as an (N+2)-th frame period. A time period corresponding to the (N+3)-th frame image may be defined as an (N+3)-th frame period.

For example, when the frequency of the master clock signal MCLK is f0, the first frequency f1=f0*4/3, and the second frequency f2=f0*4/5, a ratio between a duration of the N-th frame period and a duration of the (N+1)-th frame period is 3:5.

The panel driving signal generator 450 may receive the first and second clock signals CLK1 and CLK2 from the first and second clock generators 410 and 420, respectively. The panel driving signal generator 450 may receive the control signal provided from an external component, chip, or device.

The panel driving signal generator 450 may generate the first control signal CONT1 and the second control signal CONT2 based on the first and second clock signals CLK1 and CLK2 and the control signal.

The panel driving signal generator 450 may provide the first control signal CONT1 to the gate driver 500 and the second control signal CONT2 to the data driver 600.

The light source driving signal generator 460 may receive the first and second clock signals CLK1 and CLK2 from the first and second clock generators 410 and 420, respectively.

The light source driving signal generator 460 may generate the third control signal CONT3 based on the first and second clock signals CLK1 and CLK2. The third control signal CONT3 may be a light source driving signal.

The light source driving signal generator 460 may provide the third control signal CONT3 to the light source driver 700.

The light source driving signal generator 460 may generate the light source driving signal that is synchronized with the data signal DATA generated in the data compensator 440, with the N-th frame period defined by the first clock signal CLK1, and/or the (N+1)-th frame period defined by the second clock signal CLK2. For example, the light source driving signal may have a low period having a duration substantially the same as a duration of the N-th frame period and a high period having a duration substantially the same as a duration of the (N+1)-th frame period. The light source driving signal may represent a low driving voltage level during the low period and a high driving voltage level during the high period.

For example, when the frequency of the master clock signal MCLK is f0, the first frequency f1=f0*4/3, and the second frequency f2=f0*4/5, a ratio between a duration of the low period of the light source driving signal and a duration of the high period of the light source driving signal is 3:5.

Figure 3:
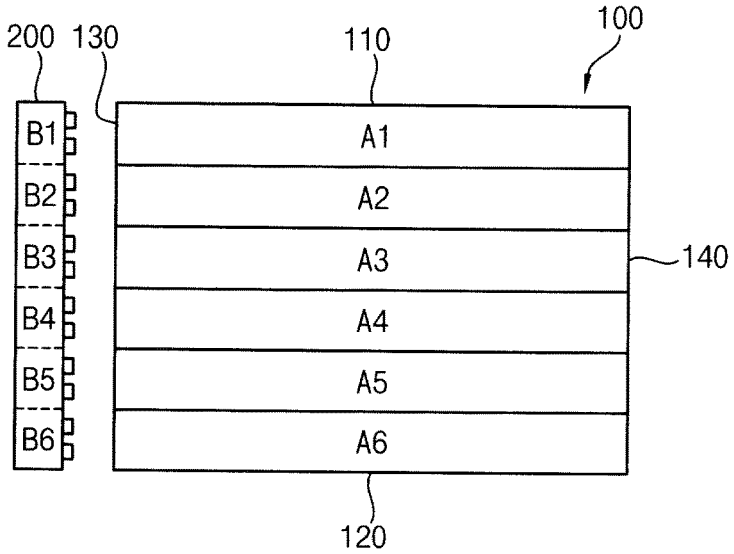
FIG. 3 is a plan view illustrating a display panel and a light source part of FIG. 1, according to exemplary embodiments of the present invention.

FIG. 3 is a plan view illustrating the display panel 100 and the light source part 200 of FIG. 1, according to exemplary embodiments of the present invention.

Referring to FIG. 3, the display panel 100 may have any suitable shape, including, for example, a rectangular shape. The display panel 100 may include a first side 110, a second side 120 facing the first side 110, a third side 130 adjacent to the first side 110 and a fourth side 140 facing the third side 130. The first and second sides 110 and 120 may be long sides of the display panel 100, and the third and fourth sides 130 and 140 may be short sides of the display panel 100.

The light source part 200 may provide light to the display panel 100. For example, the light source part 200 may be disposed adjacent to the third side 130, and formed along a scanning direction of the display panel 100.

In some cases, the light source part 200 may be disposed adjacent to the fourth side 140 of the display panel 100. In some cases, the light source part 200 may include a first light source part disposed adjacent to the third side 130 of the display panel 100 and a second light source part disposed adjacent to the fourth side 130 of the display panel 100.

The display panel 100 may include a plurality of display blocks A1, A2, A3, A4, A5, and A6. The light source part 200 may include a plurality of light source blocks B1, B2, B3, B4, B5, and B6. The light source blocks B1 to B6 may correspond to the display blocks A1 to A6, and may selectively provide a light to the display panel 100 depending on an image to be displayed in the display blocks A1 to A6 of the display panel 100.

For example, the light source blocks B1 to B6 may respectively include a plurality of LEDs.

Figure 4:
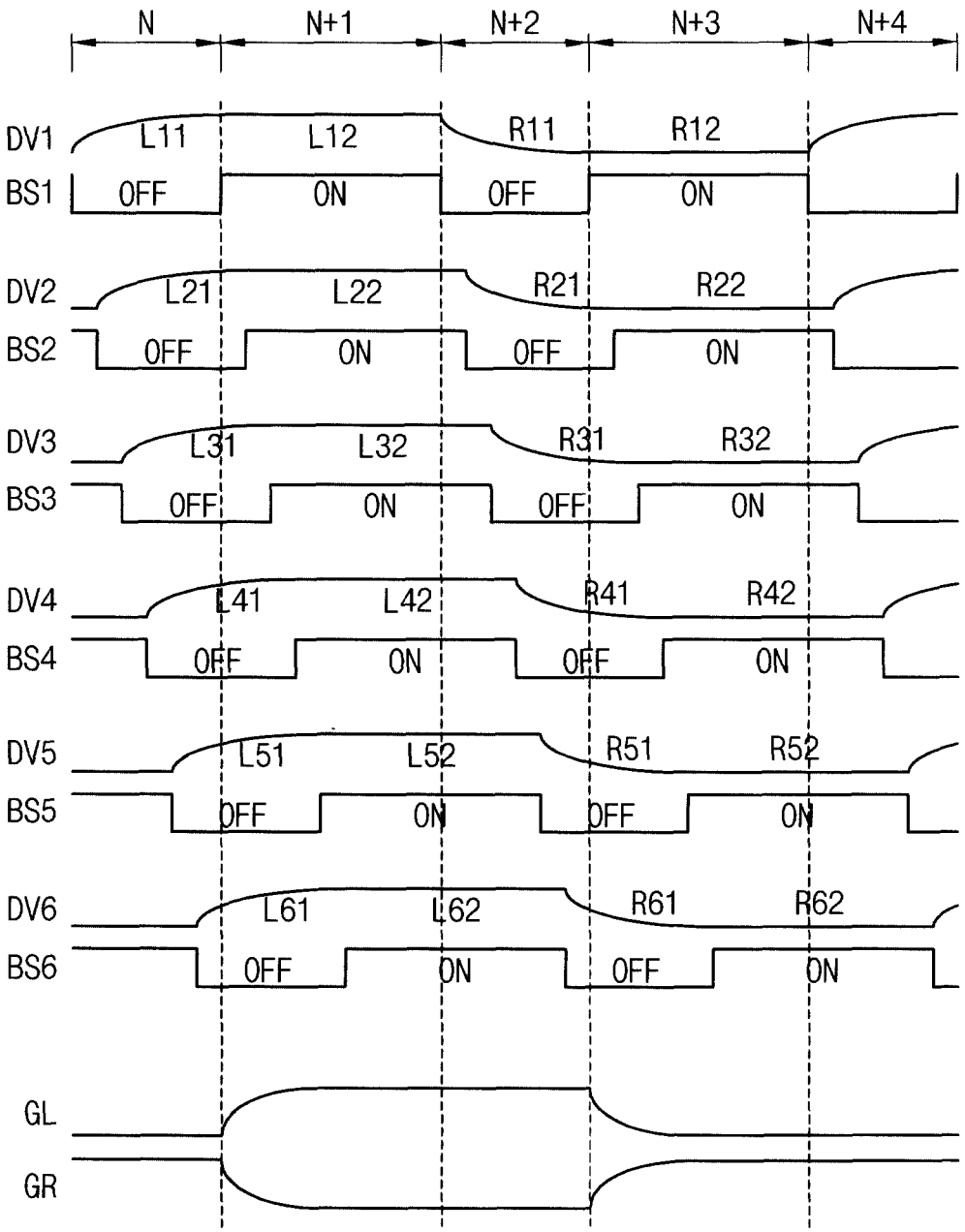
FIG. 4 is a timing diagram illustrating a panel driving signal driving the display panel of FIG. 1 and a light source driving signal driving the light source part of FIG. 1, according to exemplary embodiments of the present invention.

FIG. 4 is a timing diagram illustrating the panel driving signal driving the display panel 100 of FIG. 1, and the light source driving signal driving the light source part 200 of FIG. 1 according to exemplary embodiments of the present invention.

In FIG. 4, N, N+1, N+2, N+3, and N+4 represent, respectively, the N-th frame period corresponding to the N-th frame image, the (N+1)-th frame period corresponding to the (N+1)-th frame image, the (N+2)-th frame period corresponding to the (N+2)-th frame image the (N+3)-th frame period corresponding to the (N+3)-th frame image, and the (N+4)-th frame period corresponding to the (N+4)-th frame image.

DV1, DV2, DV3, DV4, DV5, and DV6 represent data voltages applied to the display blocks A1, A2, A3, A4, A5, and A6, respectively. FIG. 4 illustrates the data voltages DV1, DV2, DV3, DV4, DV5, and DV6 with delay of charge and discharge caused due to response delay of a liquid crystal.

BS1, BS2, BS3, BS4, BS5, and BS6 represent light source driving signals of the light source blocks B1, B2, B3, B4, B5, and B6, respectively. The light source driving signals BS1, BS2, BS3, BS4, BS5, and BS6 are sequentially changed along the scanning direction.

GL represents a left eye synchronizing signal and GR represents a right eye synchronizing signal.

Referring to FIG. 1 and FIG. 4, the first clock generator 410 may generate the first clock signal CLK1 based on the master clock signal MCLK. The second clock generator 420 may generate the second clock signal CLK2 based on the master clock signal MCLK.

The N-th frame period N may be generated based on the first clock signal CLK1. The (N+1)-th frame period N+1 may be generated based on the second clock signal CLK2. The (N+2)-th frame period N+2 may be generated based on the first clock signal CLK1. The (N+3)-th frame period N+3 may be generated based on the second clock signal CLK2. The (N+4)-th frame period N+4 may be generated based on the first clock signal CLK1.

The (N+2)-th frame period N+2, the N-th frame period N, and the (N+4)-th frame period N+4 may have substantially the same duration. The (N+3)-th frame period N+3 and the (N+1)-th frame period N+1 may have substantially the same duration. In addition, as noted above, the frame period based on the first clock signal CLK1 and the frame period based on the second clock signal CLK2 may be alternately repeated.

In FIG. 4, the first frequency of the first clock signal CLK1 is greater than the second frequency of the second clock signal CLK2. The first cycle of the first clock signal CLK1 is smaller than the second cycle of the second clock signal CLK2.

Thus, the duration of the N-th frame period N generated based on the first clock signal CLK1 is shorter than the duration of the (N+1)-th frame period N+1 generated based on the second clock signal CLK2.

For example, the ratio between the first frequency of the first clock signal CLK1 and the second frequency of the second clock signal CLK2 may be 5:3, and thus, the ratio between the duration of the N-th frame period N and the duration of the (N+1)-th frame N+1 may be 3:5.

During the N-th frame period N, data voltages L11, L21, L31, L41, L51, and L61 corresponding to the N-th frame image are provided to the display panel 100. During the (N+1)-th frame period N+1, data voltages L12, L22, L32, L42, L52, and L62 corresponding to the (N+1)-th frame image are provided to the display panel 100. During the (N+2)-th frame period N+2, data voltages R11, R21, R31, R41, R51, and R61 corresponding to the (N+2)-th frame image are provided to the display panel 100. During the (N+3)-th frame period N+3, data voltages R12, R22, R32, R42, R52, and R62 corresponding to the (N+3)-th frame image are provided to the display panel 100.

The N-th frame image is a first left eye image L11, L21, L31, L41, L51, and L61. The (N+1)-th frame image is a second left eye image L12, L22, L32, L42, L52, and L62. The (N+2)-th frame image is a first right eye image R11, R21, R31, R41, R51, and R61. The (N+3)-th frame image is a second right eye image R12, R22, R32, R42, R52, and R62.

In addition, one of the first and second left eye images may be a black image and one of the first and second right eye images may be a black image.

The light source driving signals BS1, BS2, BS3, BS4, BS5, and BS6 may be synchronized with the data signals corresponding to the frame images. The light source driving signals BS1, BS2, BS3, BS4, BS5, and BS6 may, therefore, be synchronized with the frame periods.

For example, the light source driving signals BS1, BS2, BS3, BS4, BS5, and BS6 may have the low period having a duration substantially the same as a duration of the N-th frame period and the high period having a duration substantially the same as a duration of the (N+1)-th frame period.

When the ratio between the first frequency of the first clock signal CLK1 and the second frequency of the second clock signal CLK2 is 5:3, the ratio between the duration of the N-th frame period N and the duration of the (N+1)-th frame N+1 may be 3:5, and the ratio between the duration of the low period of the light source driving signals BS1, BS2, BS3, BS4, BS5, and BS6 and the duration of the high period of the light source driving signals BS1, BS2, BS3, BS4, BS5, and BS6 may be 3:5.

The light source part 200 may be turned off during the low period of the light source driving signals BS1, BS2, BS3, BS4, BS5, and BS6, and may be turned on during the high period of the light source driving signals BS1, BS2, BS3, BS4, BS5, and BS6.

The light source part 200 may be turned off corresponding to the N-th frame period N when the first left eye images L11, L21, L31, L41, L51, and L61 are displayed on the display panel 100 and the (N+2)-th frame period N+2 when the first right eye images R11, R21, R31, R41, R51, and R61 are displayed on the display panel 100 so that crosstalk may be prevented.

In addition, the light source driving signal having a low period corresponding to the duration of the N-th frame period N, the duration of the (N+2)-th frame period N+2, or the duration of the (N+4)-th frame period N+4 and a high period corresponding to the duration of the (N+1)-th frame period N+1 or the duration of the (N+3)-th frame period N+3 may be generated so that the decrease of the luminance may be minimized.

The light source driving signal may have a low period that may be shorter or longer than the high period, depending on a response time of a liquid crystal.

Although the timing controller 400 includes the first and second clock generators 410 and 420, and the first and second clock signals respectively have different first and second frequencies, the timing controller 400 may include three or more clock generators and the three or more clock signals may respectively have three or more different frequencies.

Although the timing controller 400, including the first and second clock generators 410 and 420, is employed for the display apparatus displaying 3D images, the timing controller 400 may also be employed for various display apparatuses using various frame frequencies.

Figure 5:
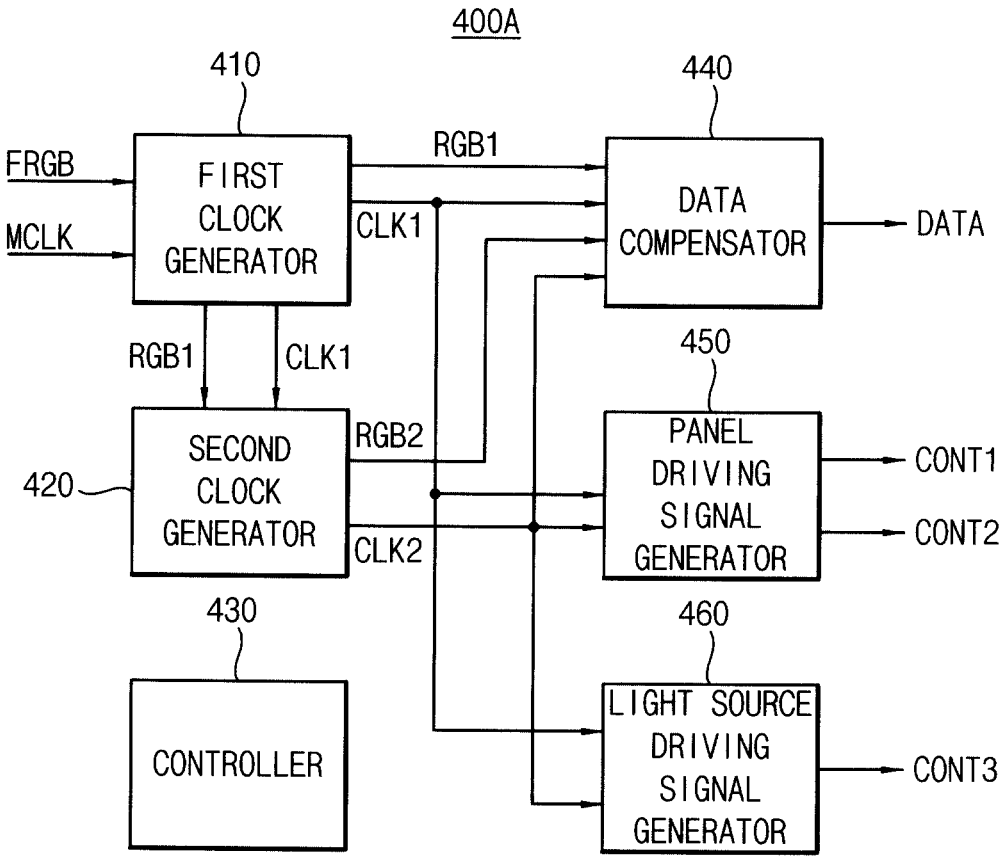
FIG. 5 is block diagram illustrating a timing controller, according to exemplary embodiments of the present invention.

FIG. 5 is block diagram illustrating a timing controller 400A according to exemplary embodiments of the present invention.

The timing controller 400A is substantially the same as the timing controller 400 of FIG. 2 except that, for example, the second clock generator 420 receives a first image RGB1 and a first clock signal CLK1 from the first clock generator 410. The same reference numerals in FIG. 5 are used to refer to the same or like parts as those described in FIG. 1, FIG. 2, FIG. 3, and FIG. 4 and any repetitive explanation concerning the above elements will be omitted.

Referring to FIG. 5, the timing controller 400A may include a first clock generator 410, a second clock generator 420, a controller 430, a data compensator 440, a panel driving signal generator 450, and a light source driving signal generator 460.

The first clock generator 410 may receive the converted image FRGB and the master clock signal MCLK from the FRC 300. The first clock generator 410 may include a first PLL (not shown) generating a first clock signal CLK1 based on the master clock signal MCLK and a first synchronizing part (not shown) synchronizing the converted image FRGB with the first clock signal CLK1 to generate a first image RGB1.

The first clock generator 410 may provide the first image RGB1 to the second clock generator 420 and the data compensator 440. The first clock generator 410 may provide the first clock signal CLK1 to the second clock generator 420, the data compensator 440, the panel driving signal generator 450, and the light source driving signal generator 460.

In some cases, the first clock generator 410 may receive the master clock signal MCLK and the input image RGB from an external element, source, chip, or device. The first synchronizing part may synchronize the input image RGB with the first clock signal CLK1 to generate a first image RGB1.

The second clock generator 420 may receive the first image RGB1 and the first clock signal CLK1 from the first clock generator 410. The second clock generator 420 may include a second PLL (not shown) generating a second clock signal CLK2 based on the first clock signal CLK1. The second clock generator 420 may include a second synchronizing part (not shown) synchronizing the first image RGB1 with the second clock signal CLK2 to generate a second image RGB2.

The second clock generator 420 may provide the second image RGB2 to the data compensator 440. The second clock generator 420 may provide the second clock signal CLK2 to the data compensator 440, the panel driving signal generator 450, and the light source driving signal generator 460.

In some cases, the second clock generator 420 may receive an input image RGB from an external element, source, chip, or device. The second synchronizing part may synchronize the input image RGB with the second clock signal CLK2 to generate a second image RGB2.

The light source part 200 may be turned off during a period corresponding to the N-th frame period N when the first left eye images L11, L21, L31, L41, L51, and L61 are displayed on the display panel 100 and the (N+2)-th frame period N+2 when the first right eye images R11, R21, R31, R41, R51, and R61 are displayed, on the display panel 100 so that crosstalk may be prevented.

In addition, the light source driving signal having a low period corresponding to the duration of the N-th frame period N and the duration of the (N+2)-th frame period N+2 and a high period corresponding to the duration of the (N+1)-th frame period N+1 and the duration of the (N+3)-th frame period N+3 is generated so that the decrease of the luminance may be minimized.

According to exemplary embodiments of the present invention described hereinabove, a display panel and a light source part may be driven using a first clock signal having a first frequency and a second clock signal having a second frequency so that a crosstalk and a decrease of luminance may be minimized.

Thus, a display quality of the display apparatus may be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A method of driving a display panel, the method comprising:

providing a first clock signal having a first frequency based on a master clock signal;

providing a data signal of an N-th frame image to the display panel using the first clock signal, wherein N is a natural number greater than 0;

providing a second clock signal having a second frequency, the second frequency being different from the first frequency; and providing a data signal of an (N+1)-th frame image to the display panel using the second clock signal, wherein one of the first and second frequencies is greater than a frequency of the master clock signal, and the other of the first and second frequencies is smaller than the frequency of the master clock signal, wherein a sum of a cycle of the first clock signal and a cycle of the second clock signal is twice as great as a cycle of the master clock signal, wherein a ratio between the first and second frequencies is adjusted in real time, wherein the method further comprises providing a light source driving signal to a light source part to provide radiation to the display panel using the first clock signal and the second clock signal, wherein the light source driving signal comprises a low voltage level during a low period and a high voltage level during a high period, wherein a duration of the low period of the light source driving signal is substantially the same as the duration of the N-th frame period set by the first clock signal, and wherein a duration of the high period of the light source driving signal is substantially the same as the duration of the (N+1)-th frame period set by the second clock signal.

2. The method of claim 1, wherein a duration of an (N+2)-th frame period corresponding to an (N+2)-th frame image is the same as a duration of an N-th frame period corresponding to the N-th frame image, wherein a duration of an (N+3)-th frame period corresponding to an (N+3)-th frame image is the same as a duration of an (N+1)-th frame period corresponding to the (N+1)-th frame image, and wherein the duration of the N-th frame period is not the same as the duration of the (N+1)-th frame period.

3. The method of claim 2, wherein the N-th frame image comprises a first left eye image, the (N+1)-th frame image comprises a second left eye image, the (N+2)-th frame image comprises a first right eye image, and the (N+3)-th frame image comprises a second right eye image.

4. The method of claim 1, wherein the second frequency of the second clock signal is less than the first frequency of the first clock signal.

5. The method of claim 1, wherein a plurality of light source blocks disposed in a horizontal direction of a frame image selectively provide the radiation to a plurality of display blocks of the display panel depending on an image displayed on the display blocks.

6. The method of claim 1, wherein the first clock signal is provided using the master clock signal provided from an external device, and wherein the second clock signal is provided using the master clock signal provided from the external device.

7. The method of claim 1, wherein the first clock signal is provided using the master clock signal provided from an external device, and wherein the second clock signal is provided using the first clock signal.

8. The method of claim 1, wherein each of the first clock signal and the second clock signal is provided using a phase locked loop.

9. A display apparatus, comprising:

a display panel to display an image;

a timing controller to provide a first clock signal having a first frequency and a second clock signal having a second frequency different from the first frequency, and to provide a data signal of an N-th frame image to the display panel using the first clock signal and a data signal of an (N+1)-th frame image to the display panel using the second clock signal, wherein N is a natural number greater than 0; and a light source part to provide radiation to the display panel, wherein the first clock signal is generated based on a master clock signal, and wherein one of the first and second frequencies is greater than a frequency of the master clock signal, and the other of the first and second frequencies is smaller than the frequency of the master clock signal, wherein a sum of a cycle of the first clock signal and a cycle of the second clock signal is twice as great as a cycle of the master clock signal, wherein a ratio between the first and second frequencies is adjusted in real time, wherein the timing controller is configured to provide a light source driving signal to drive the light source part using the first clock signal and the second clock signal, wherein the light source driving signal comprises a low voltage level during a low period and a high voltage level during a high period, wherein a duration of the low period of the light source driving signal is substantially the same as the duration of the N-th frame period set by the first clock signal, and wherein a duration of the high period of the light source driving signal is substantially the same as the duration of the (N+1)-th frame period set by the second clock signal.

10. The display apparatus of claim 9, wherein a duration of an (N+2)-th frame period corresponding to an (N+2)-th frame image is substantially the same as a duration of an N-th frame period corresponding to the N-th frame image, wherein a duration of an (N+3)-th frame period corresponding to an (N+3)-th frame image is substantially the same as a duration of an (N+1)-th frame period corresponding to the (N+1)-th frame image, and wherein the duration of the N-th frame period is not the same as the duration of the (N+1)-th frame period.

11. The display apparatus of claim 10, wherein the N-th frame image comprises a first left eye image, the (N+1)-th frame image comprises a second left eye image, the (N+2)-th frame image comprises a first right eye image, and the (N+3)-th frame image comprises a second right eye image.

12. The display apparatus of claim 9, wherein the second frequency of the second clock signal is less than the first frequency of the first clock signal.

13. The display apparatus of claim 9, wherein the light source part comprises:

a plurality of light source blocks disposed in a horizontal direction of a frame image, wherein the light source blocks are configured to selectively provide the radiation to a plurality of display blocks of the display panel depending on an image displayed on the display blocks.

14. The display apparatus of claim 9, wherein the timing controller comprises a first clock generator to provide the first clock signal and a second clock generator to provide the second clock signal, wherein the first clock generator is configured to provide the first clock signal using the master clock signal provided from an external device, and wherein the second clock generator is configured to provide the second clock signal using the master clock signal provided from the external device.

15. The display apparatus of claim 9, wherein the timing controller comprises a first clock generator to provide the first clock signal and a second clock generator to provide the second clock signal, wherein the first clock generator is configured to provide the first clock signal using the master clock signal provided from an external device, and wherein the second clock generator is configured to provide the second clock signal using the first clock signal received from the first clock generator.

16. The display apparatus of claim 9, wherein:

the timing controller comprises a first clock generator to provide the first clock signal and a second clock generator to provide the second clock signal; and each of the first clock generator and the second clock generator comprises a phase locked loop.

17. The method of claim 1, wherein the data signal of an N-th frame image has a gray scale value greater than zero.

* * * * *